US007527248B2

(12) United States Patent
Cobb, Jr.

(10) Patent No.: US 7,527,248 B2
(45) Date of Patent: May 5, 2009

(54) DIAPHRAGM CARBURETTOR WITH SINGLE PUMP AND METER BLOCK FOR INTERNAL COMBUSTION ENGINES

(75) Inventor: William T. Cobb, Jr., St. Petersburg, FL (US)

(73) Assignee: EMAK S.p.A, Reggio Emila (IT)

( * ) Notice: Subject to any disclaimer, the term of this patent is extended or adjusted under 35 U.S.C. 154(b) by 0 days.

(21) Appl. No.: 11/846,126

(22) Filed: Aug. 28, 2007

(65) Prior Publication Data

US 2008/0191368 A1 Aug. 14, 2008

Related U.S. Application Data

(60) Provisional application No. 60/840,461, filed on Aug. 28, 2006.

(51) Int. Cl.
*F02M 17/04* (2006.01)

(52) U.S. Cl. ..... 261/35; 261/DIG. 68

(58) Field of Classification Search ..... 261/35, 261/69.1, 69.2, DIG. 68
See application file for complete search history.

(56) References Cited

U.S. PATENT DOCUMENTS

| | | | | |
|---|---|---|---|---|
| 2,918,046 | A * | 12/1959 | Teagarden | 123/495 |
| 3,104,617 | A * | 9/1963 | Barr | 417/479 |
| 3,321,192 | A * | 5/1967 | Phillips | 261/35 |
| 3,738,623 | A * | 6/1973 | Tuckey | 261/35 |
| 3,779,529 | A * | 12/1973 | Kimura | 261/35 |
| 4,481,152 | A * | 11/1984 | Kobayashi et al. | 261/35 |
| 4,944,897 | A * | 7/1990 | Andreasson | 261/35 |
| 6,446,939 | B1 | 9/2002 | Hoppe et al. | |
| 6,622,992 | B2 * | 9/2003 | Woody | 261/35 |
| 2002/0195726 | A1 * | 12/2002 | Galka et al. | 261/35 |
| 2004/0232568 | A1 * | 11/2004 | Ichihara et al. | 261/35 |
| 2006/0151892 | A1 * | 7/2006 | Tobinai | 261/35 |

FOREIGN PATENT DOCUMENTS

| | | | | |
|---|---|---|---|---|
| JP | 60-88857 | A * | 5/1985 | 261/35 |
| WO | 0011334 | | 3/2000 | |

* cited by examiner

*Primary Examiner*—Richard L Chiesa
(74) *Attorney, Agent, or Firm*—Browdy and Neimark, P.L.L.C.

(57) ABSTRACT

A diaphragm carburetor (1) for internal combustion engines includes a carburetor body (2,2') provided with a feed duct (3) of an air/fuel mixture to the engine, the duct (3) being intercepted by at least one butterfly valve (20);

a pumping device including a diaphragm pump (6) communicating on one side with the engine and on the other side with a fuel tank, the diaphragm pump (6) being driven by the pulses corning from the engine;

a metering device including a diaphragm meter (7) adapted to keep a first chamber (13) and a second chamber (12) separate, with the meter (7) interposed, the first chamber (13) being at environmental pressure, and the second chamber (12) communicating both with the diaphragm pump (6), on the side which communicates with the tank, through a line intercepted by a valve controlled by the meter (7) itself, and with the feed duct (3) of the mixture, where the pumping device and the metering device are integrally made on a single block (5) fixed directly on one side of the carburetor body (2).

11 Claims, 18 Drawing Sheets

DIAPHRAGM CARBURETTOR WITH SINGLE PUMP AND METER BLOCK FOR INTERNAL COMBUSTION ENGINES

TECHNICAL FIELD

The present invention refers to a diaphragm carburettor with single pump and meter block.

More in particular, the present invention refers to carburettors for small two-stroke internal combustion engines adapted to be applied on portable devices, such as for example trimmers, mowers, chain saws, grass blowers and the like.

BACKGROUND ART

Diaphragm carburettors are known which comprise a carburettor body with venturi duct to which a diaphragm pump and a diaphragm meter are fixed.

The meter is subject to the reduced pressure present in the insertion venturi duct of the mixture to the engine on the side of the diaphragm soaked by the fuel and to a pre-established pressure, for example atmospheric pressure, on the opposite side. This pressure difference on the two opposite sides of the meter diaphragm permits the diaphragm to oscillate, in such a manner driving a needle valve which shuts the fuel passage opening. In particular, the needle valve is held in closed position by a spring, blocking the passage of the fuel, and is driven open by the diaphragm against the spring. In practice, when the side of the diaphragm communicating with the venturi duct is in reduced pressure, the needle valve is driven open and the fuel reaches the distribution chamber placed on the same side communicating with the venturi duct, which draws the fuel through suitable fuel insertion opens.

The degree of opening of the needle valve is proportional to the reduced pressure present in the distribution chamber, which varies as a function of the adjustment of a butterfly valve which intercepts the insertion duct of the carburettor crossed by air.

The diaphragm pump sends the fuel to the needle valve, waiting for it to be opened by the diaphragm meter. In particular, the diaphragm pump has one side in communication with the fuel tank and the opposite side in communication with the engine crankcase which sends pressure pulses generated by the piston moving in the engine through a suitable duct crossed by the mixture. These pulses make the pump diaphragm oscillate, and the pump pushes the fuel towards the needle valve.

In the prior art, the pump and the meter are normally fixed on two opposite sides of the block comprising the insertion venturi tube of the mixture.

This configuration of the prior art presents several drawbacks.

In fact, the known pump and meter do not lend themselves to being applied both on carburettors provided with only the venturi duct of standard type, and on carburettors with two insertion ducts, one venturi for the air/fuel mixture, the other only for the air, so to obtain a stratified charge feeding.

In the latter case, both ducts are shut by a butterfly, and the two butterflies must move synchronously.

This is due to the fact that the distance between the pump and the meter increases since the space interposed between the two, which before was occupied by a single duct carburettor body, is now occupied by a body comprising two ducts, with a substantial doubling of distance; this is also reflected in the prearranged adjustment and lever system for the correct functioning of the butterfly valve, which will inevitably be modified.

In substance, the passage from the standard feeding to the stratified charge feeding involves, in the prior art, the modification of all carburettor components, i.e. the carburettor body, as well as the pump and meter.

In fact, due to the greater size of the stratified charge carburettor, which has two ducts instead of one, the arrangement of the pump and meter, opposite each other and with the two-duct carburettor interposed as occurs in some cases, make the hydraulic connections between the pump and meter difficult, as well as the adjustment of these connections.

In addition, in the prior art, the stratified charge carburettor has a considerably complicated timed management of the butterfly valve.

A modular diaphragm carburettor is disclosed by U.S. Pat. No. 6,446,939 in which the pumping means and the metering means of the fuel are made in two blocks both positioned on the same side of the venture passage.

Nevertheless they comprise a plurality of mating plates in which the passages through the carburettor is made, and the machining of such passages is far to be easy.

There is therefore the strong need to have available a single block comprising a diaphragm pump and a diaphragm meter, which are adapted to be indiscriminately applied both on a standard application, typical of the carburettor bodies with only one venturi duct, and on a stratified charge application, with two flanking parallel ducts, in the scope of a simple, extremely compact and versatile structural solution.

DISCLOSURE OF INVENTION

The object of the present invention is to provide a diaphragm carburettor having structural and functional characteristics such to satisfy the aforesaid needs and to overcome at the same time the drawbacks mentioned with reference to the prior art.

BEST MODE FOR CARRYING OUT THE INVENTION

With reference to the aforesaid figures, a diaphragm carburettor in accordance with the present invention is entirely indicated with 1.

Figure 17:
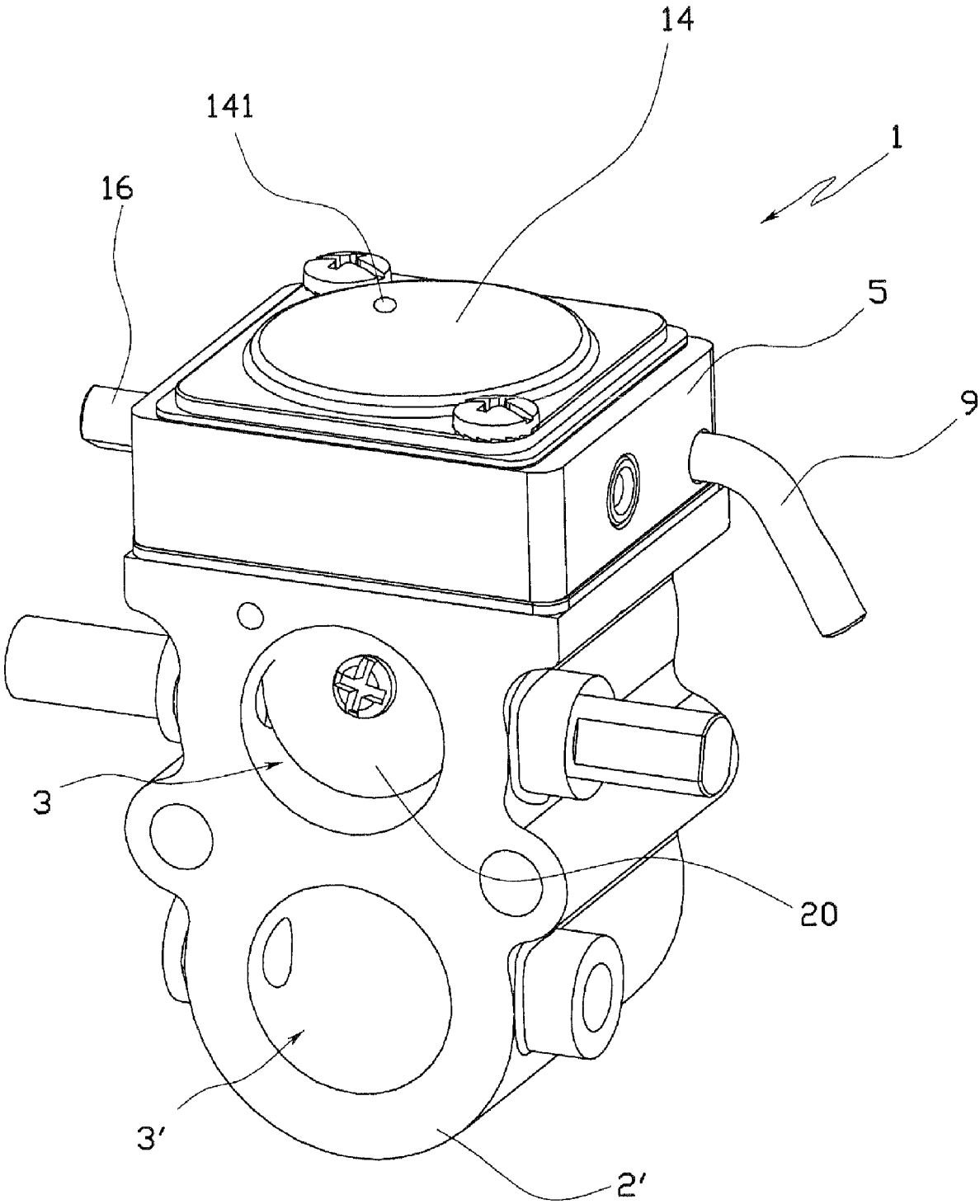
FIG. 17 shows a perspective view of the carburettor according to the present invention, in accordance with a second embodiment.

The carburettor 1 comprises a carburettor body 2 provided with a feed venturi duct 3 of the air/fuel mixture to the engine, in the first embodiment (FIG. 1-15), or two ducts 3 and 3', of which 3 is a venturi duct, in the second embodiment (FIG. 17) and a single block 5, which will be better described below, fixed directly on the carburettor body 2, on the side next to the venturi duct 3.

The first embodiment will be herebelow described with reference to FIG. 3, 3A, and to the other figures with indication of the proper figure where the referenced item is shown.

Figure 3:
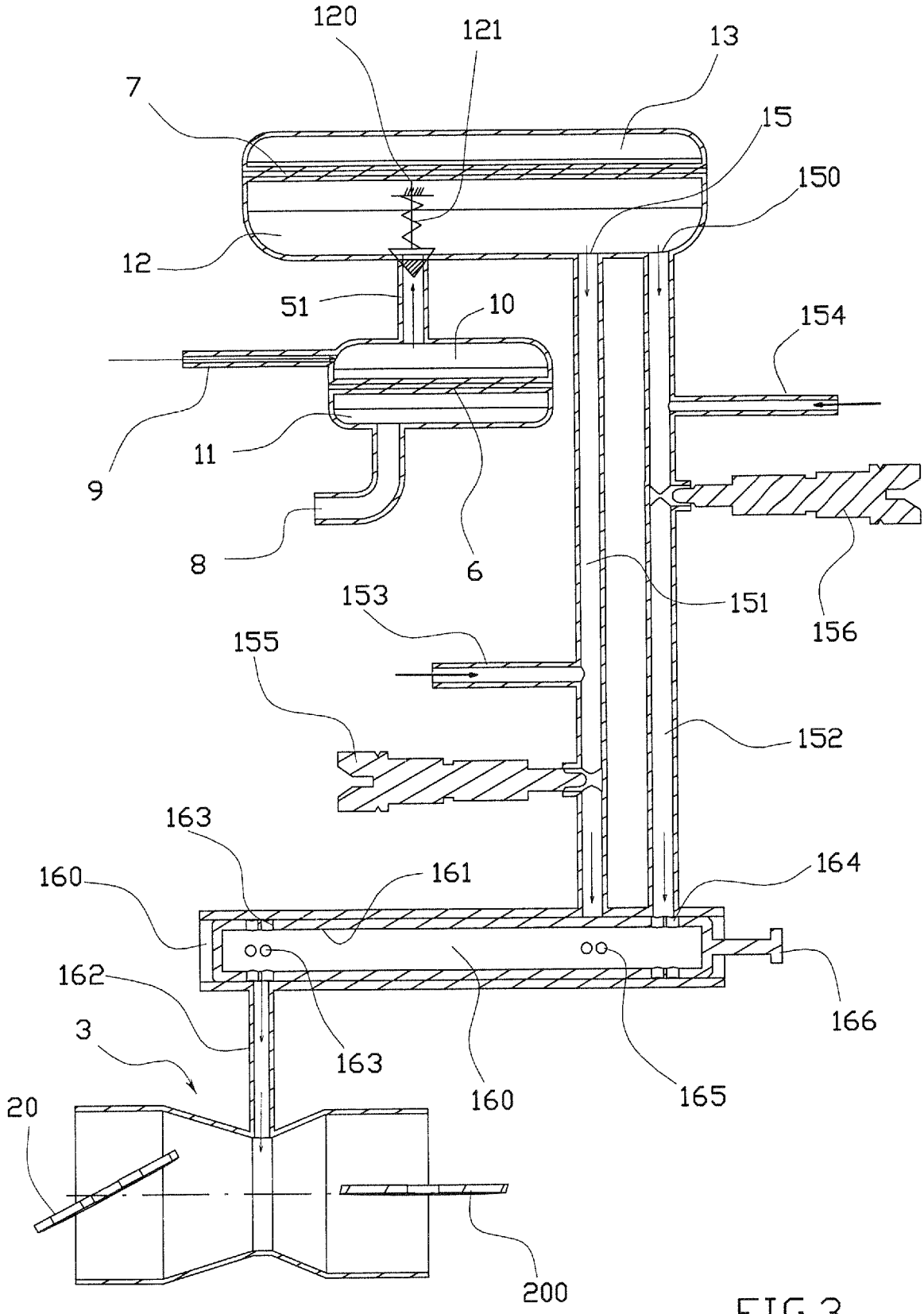
FIG. 3 is a schematic diagram of the invention.
Figure 3A:
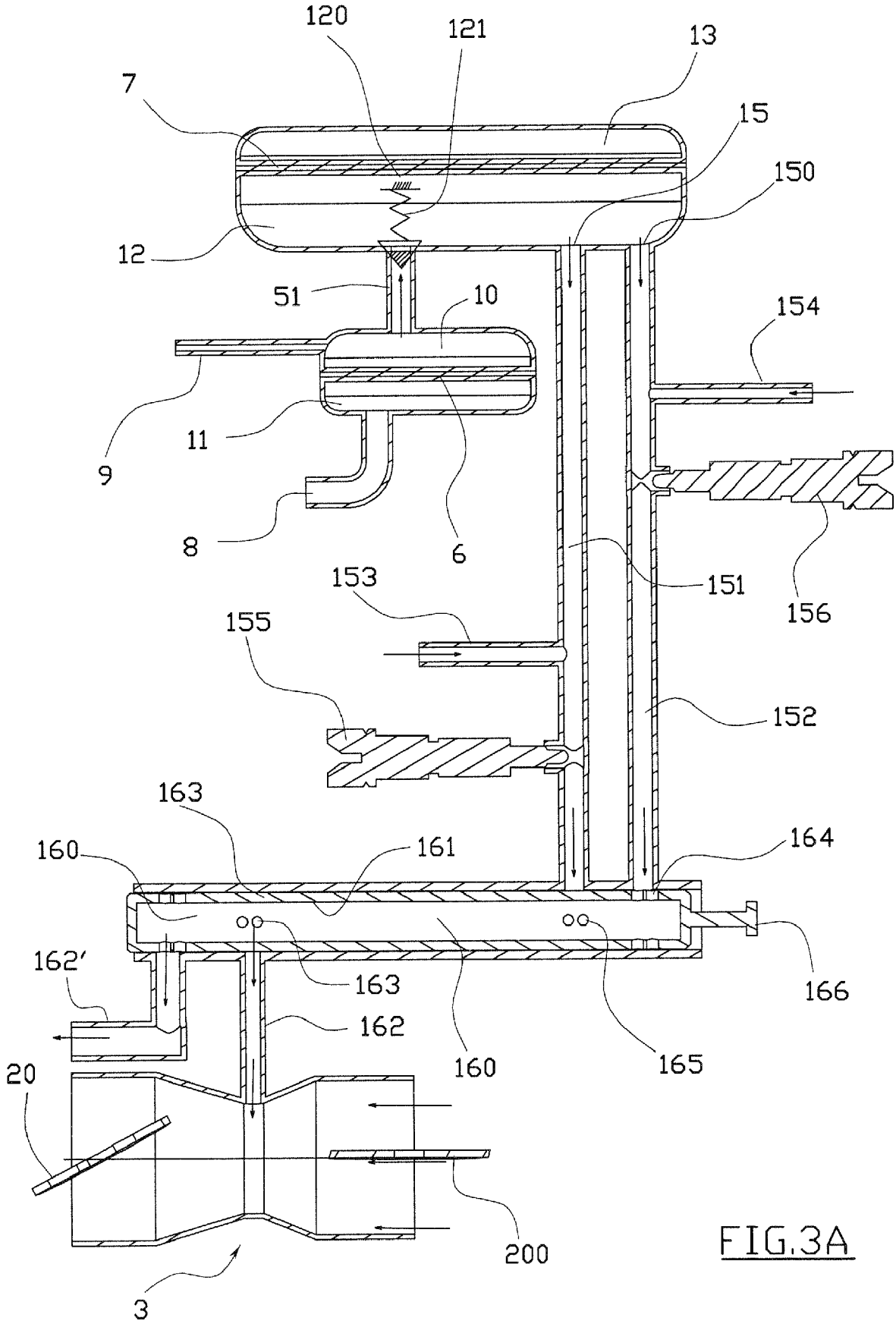
FIG. 3A is a schematic diagram like that of FIG. 3, suitable for a CWI (Compressed Wave Injection) system as that disclosed in WO 00/11334.

With reference to the first embodiment, the venturi duct 3 has an inlet side for the air and an outlet side for the air/fuel mixture to the engine, respectively to the right and left side of FIG. 3, 3A.

The venturi duct 3 is intercepted by a first butterfly valve 20, and by a second butterfly valve 200 which is controlled by the user in order to vary the power supplied to the engine, in normal mode and choke (starter) operation mode.

In accordance with the present invention, a pump comprising a diaphragm 6 and a metering chamber 12 delimited by a metering diaphragm 7 are integrally made on the single block 5, with parallelepiped configuration.

Figure 5:
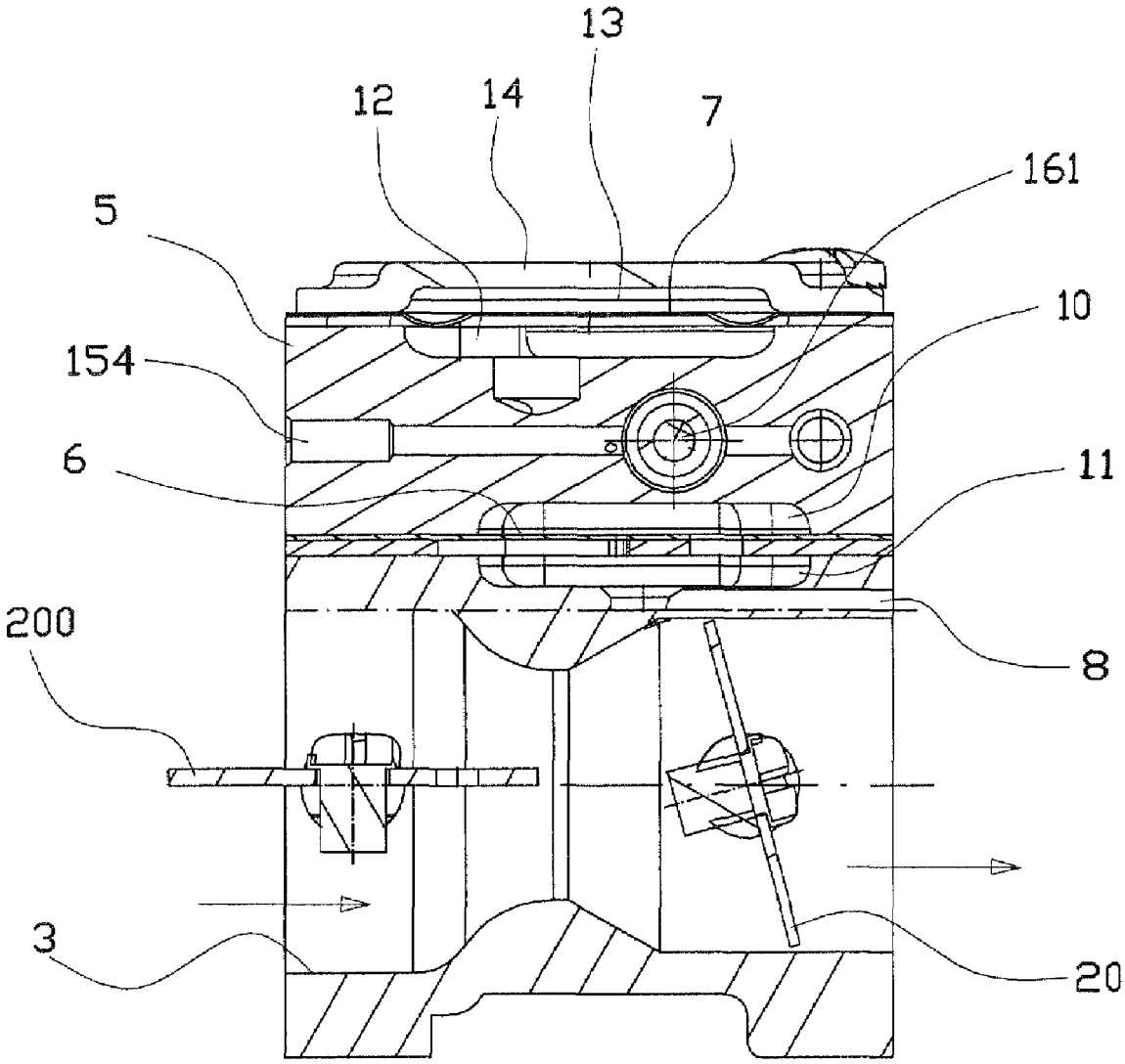
FIG. 5 shows a sectional view taken along the lines V-V shown in FIG. 4.
Figure 6:
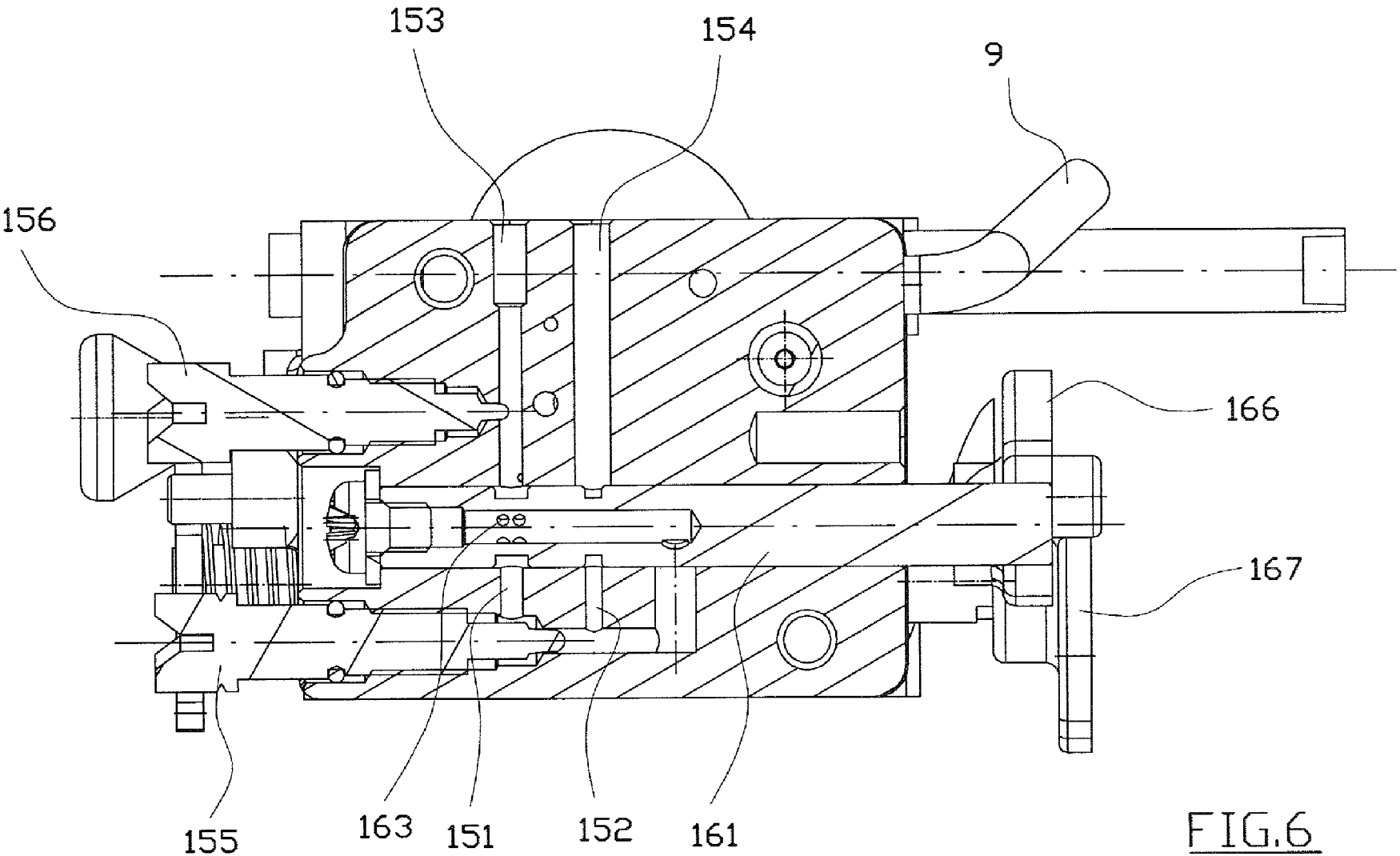
FIG. 6 shows a sectional view taken along the lines VI-VI shown in FIG. 4.
Figure 7:
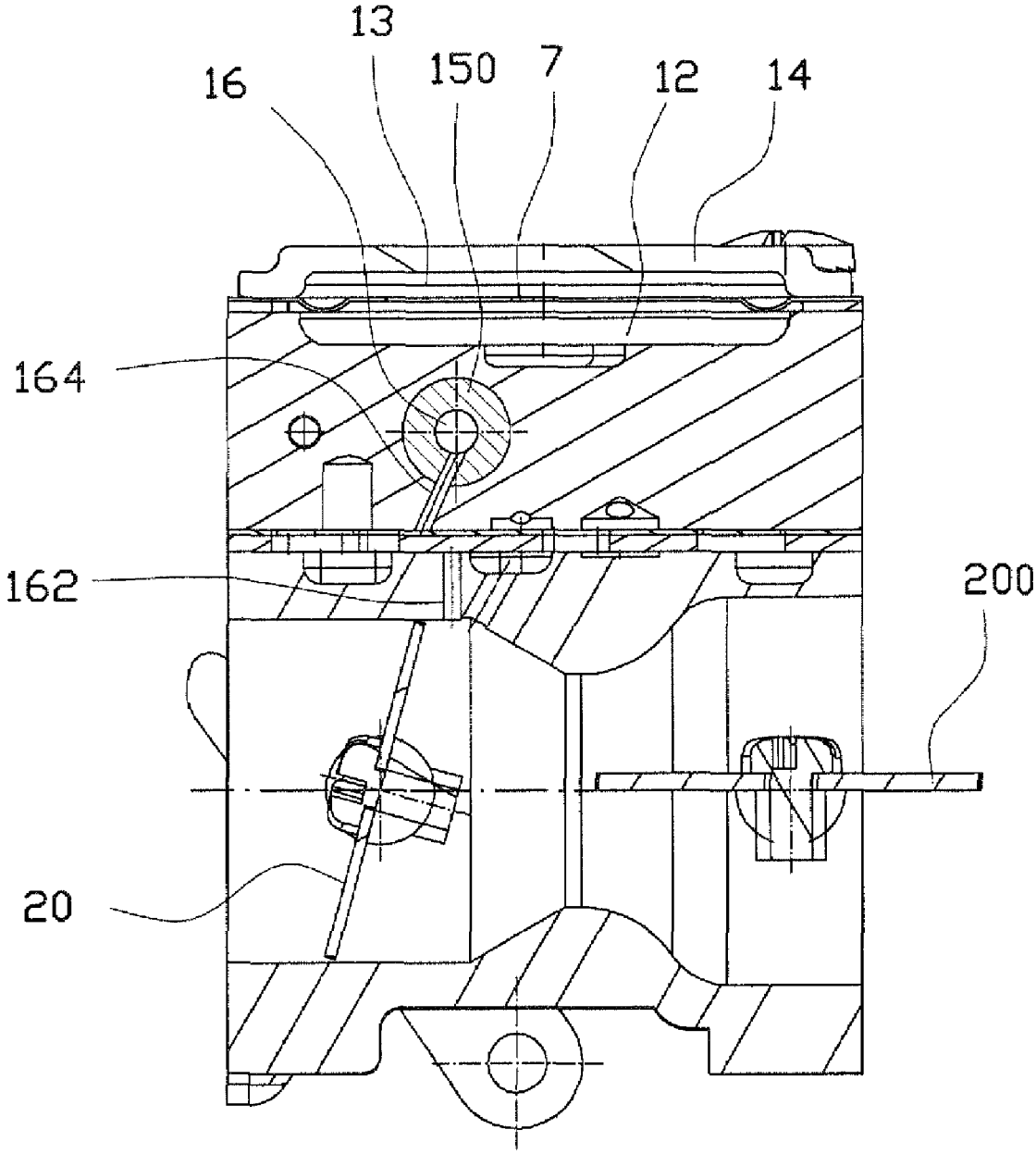
FIG. 7 shows a sectional view taken along the lines VII-VII shown in FIG. 4.
Figure 8:
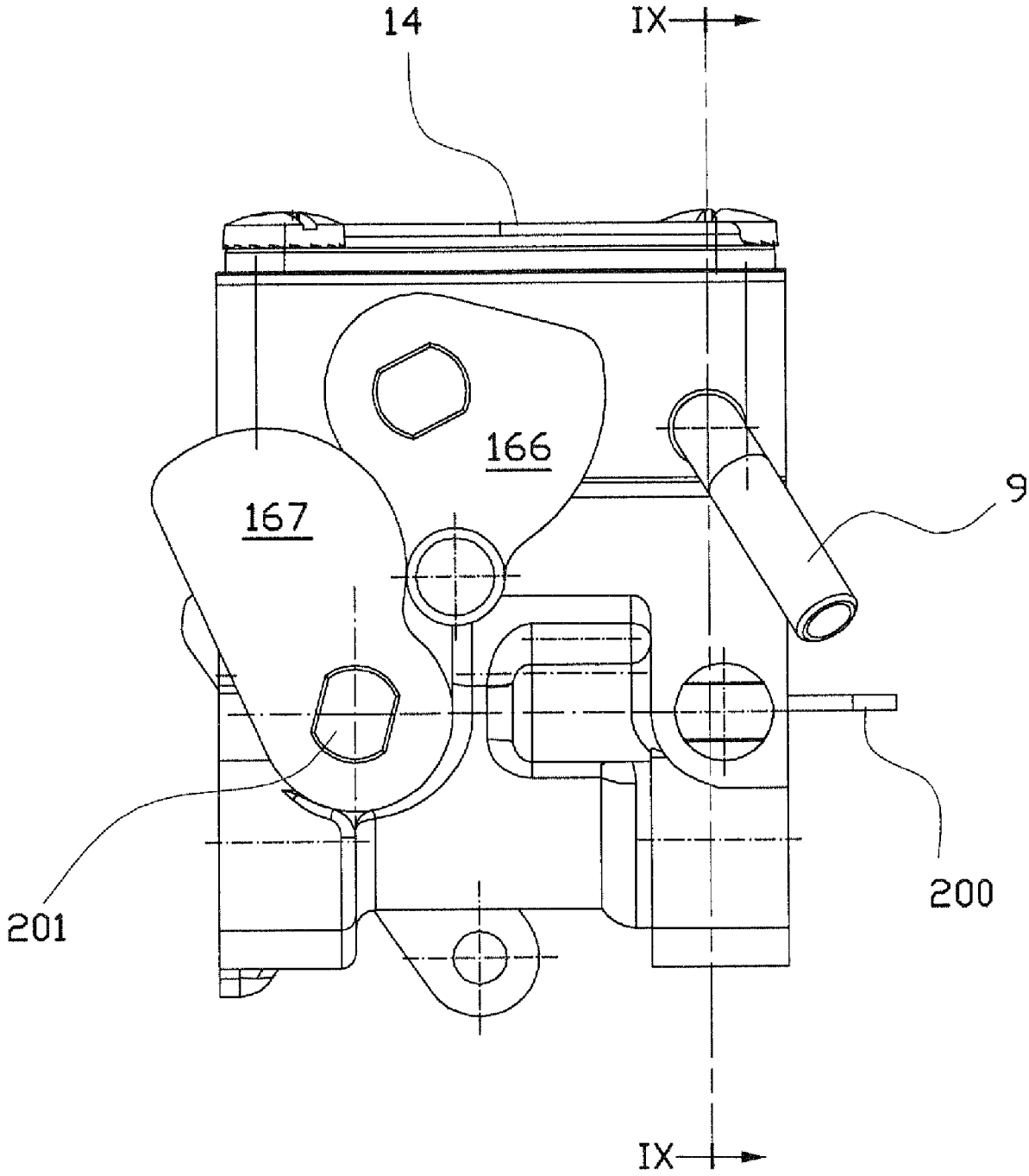
FIG. 8 shows a lateral view of the carburettor.
Figure 9:
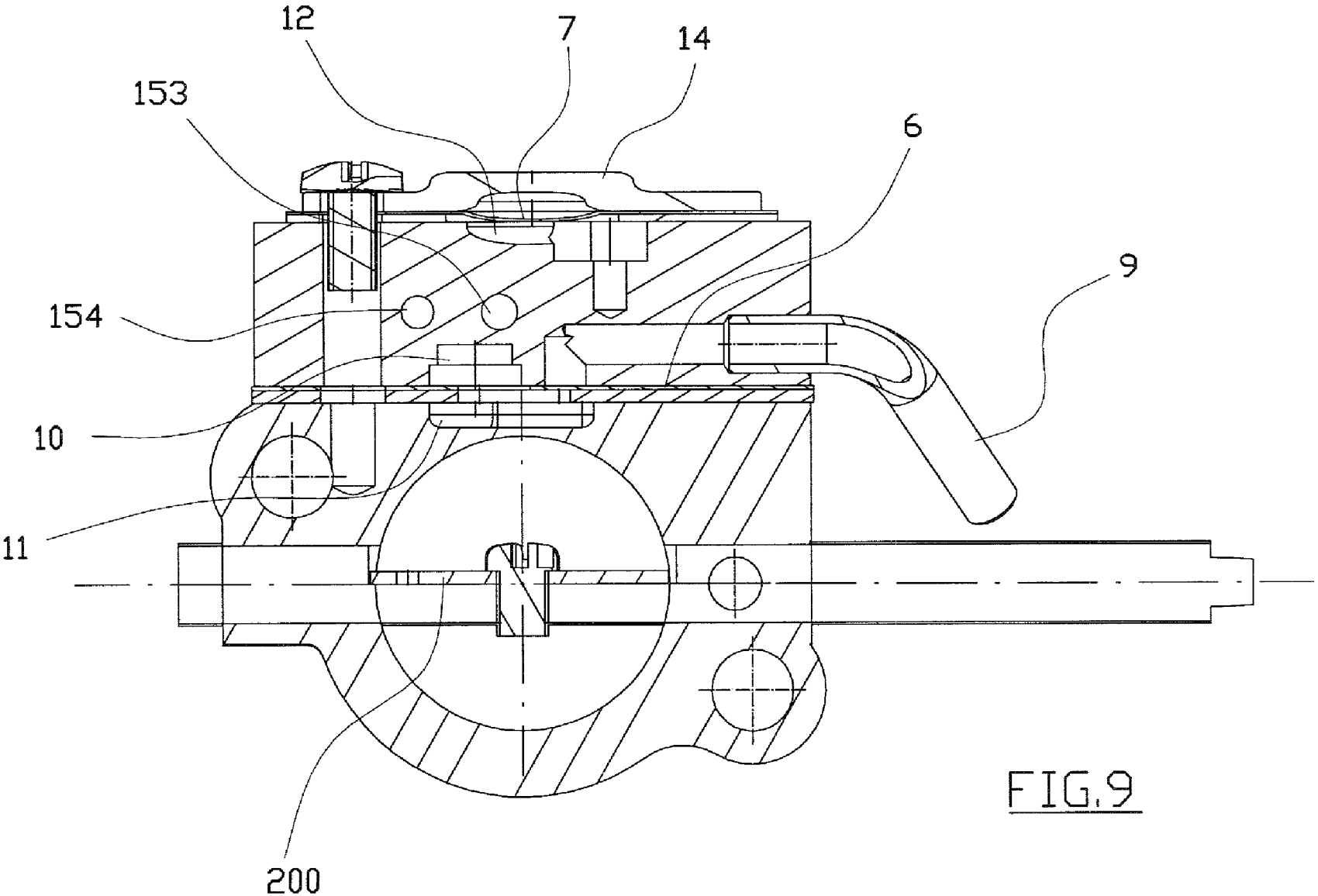
FIG. 9 shows a sectional view taken along the lines IX-IX shown in FIG. 8.
Figure 10:
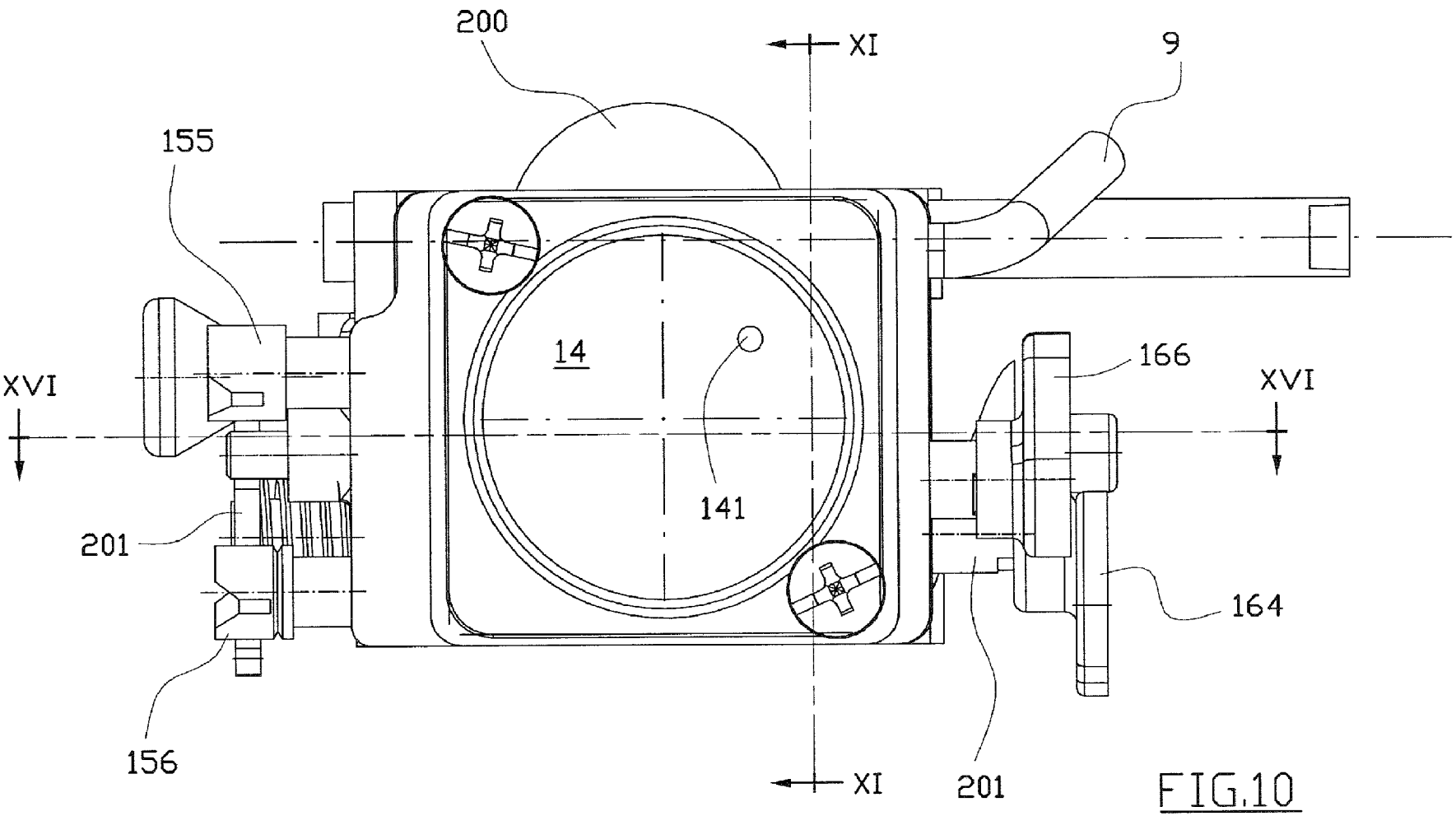
FIG. 10 shows a view from the above of the carburettor.
Figure 11:
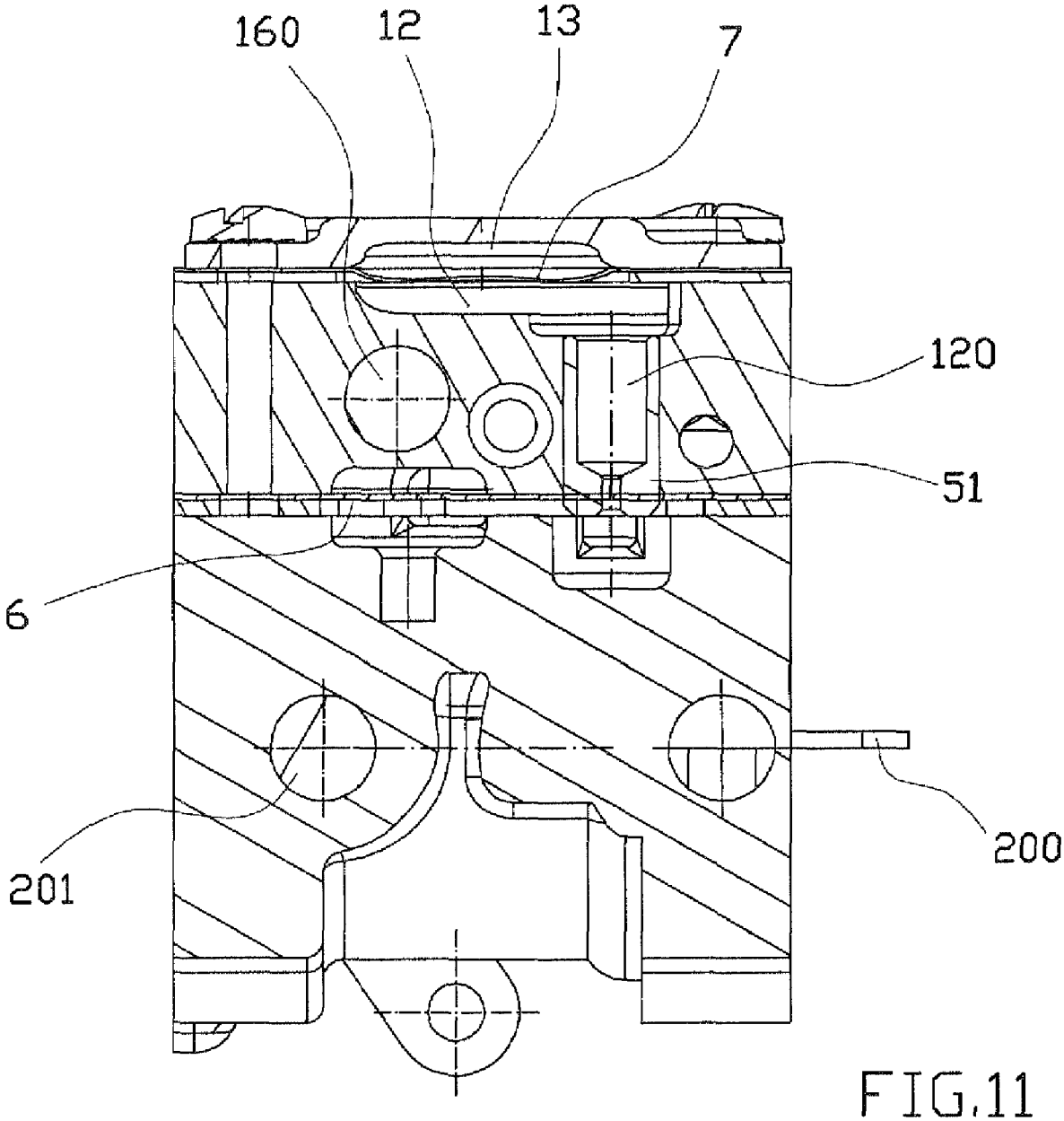
FIG. 11 shows a sectional view taken along the lines XI-XI shown in FIG. 10.
Figure 12:
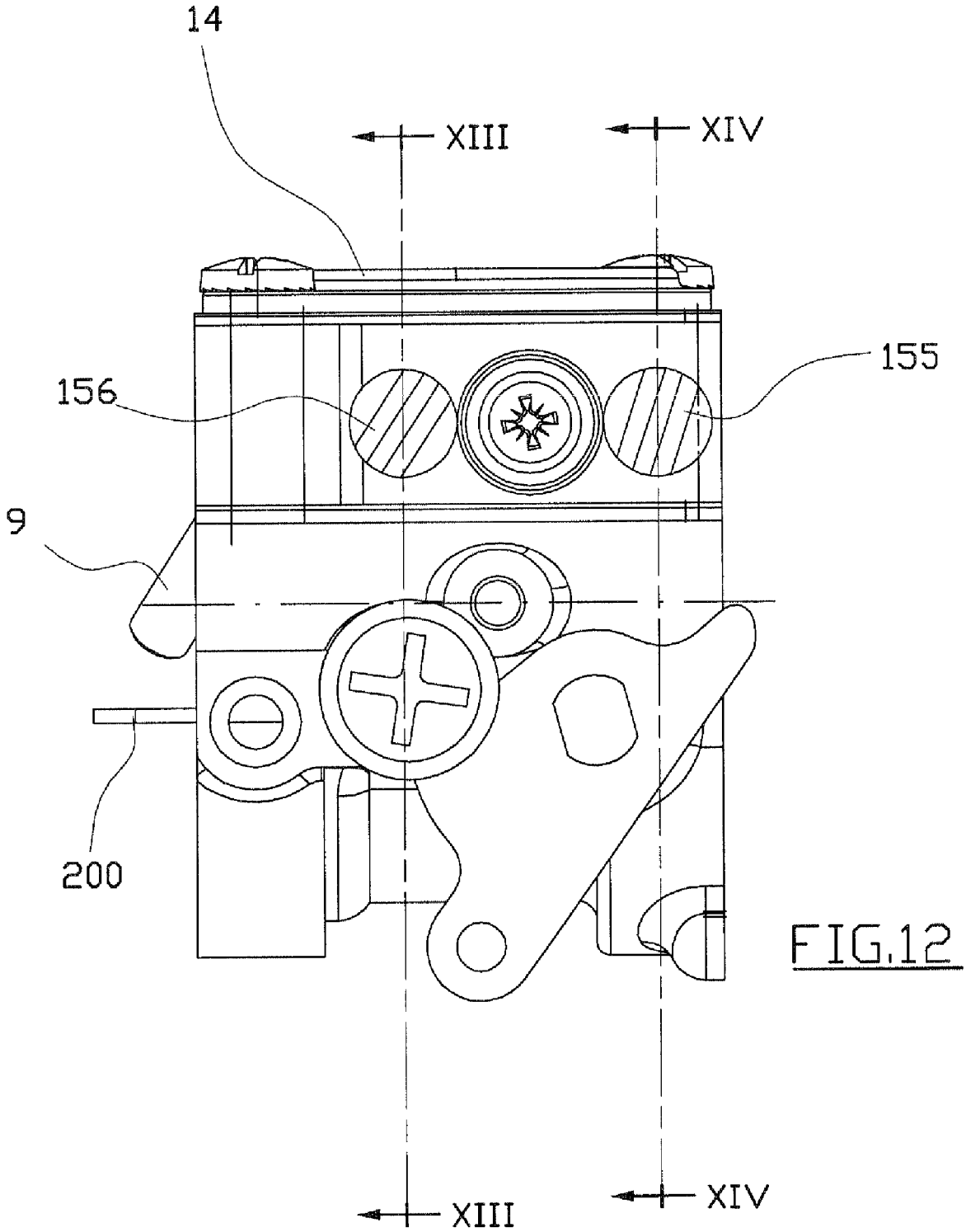
FIG. 12 is a side view of the carburettor.
Figure 13:
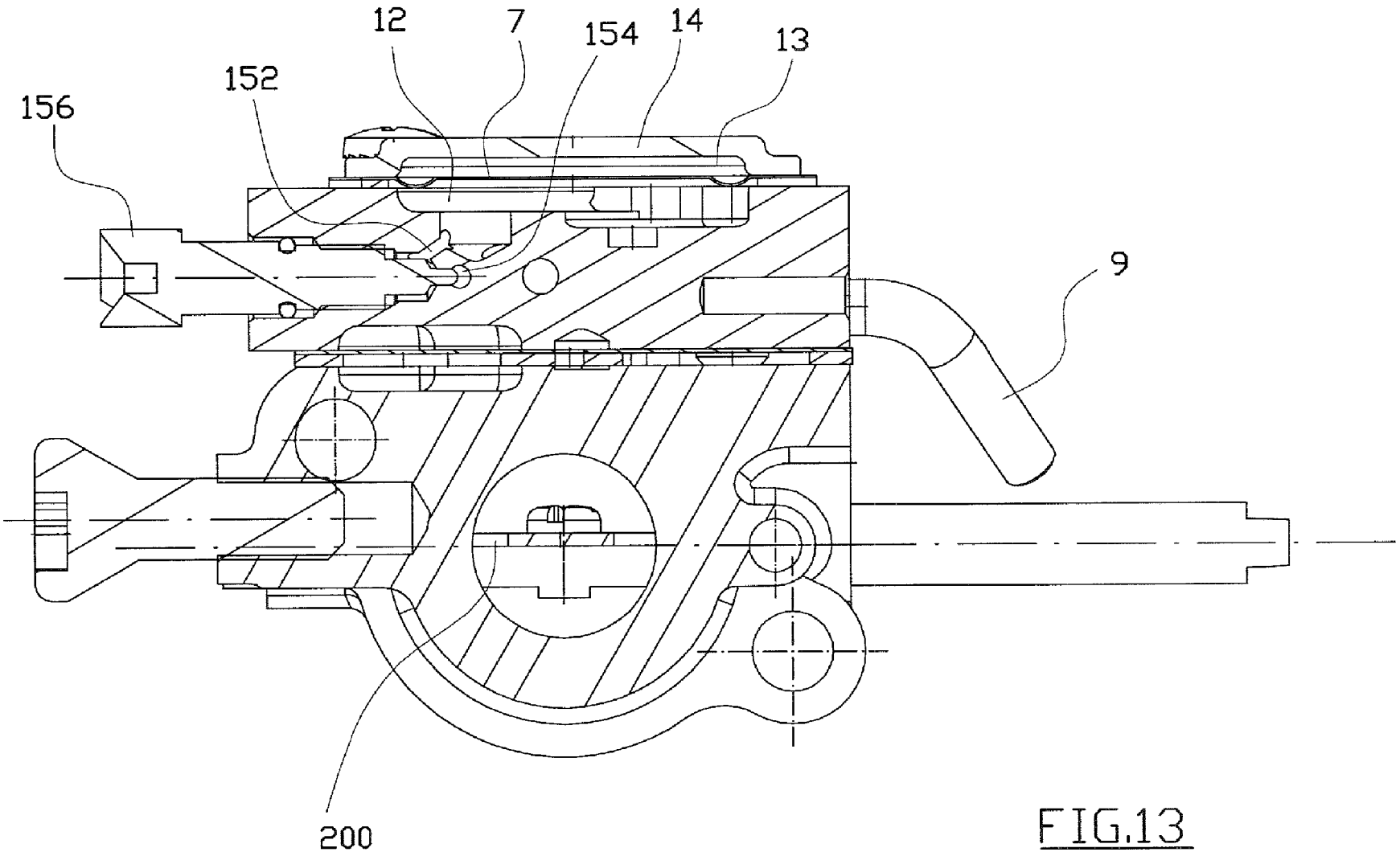
FIG. 13 shows a sectional view taken along the lines XIII-XIII shown in FIG. 12.
Figure 14:
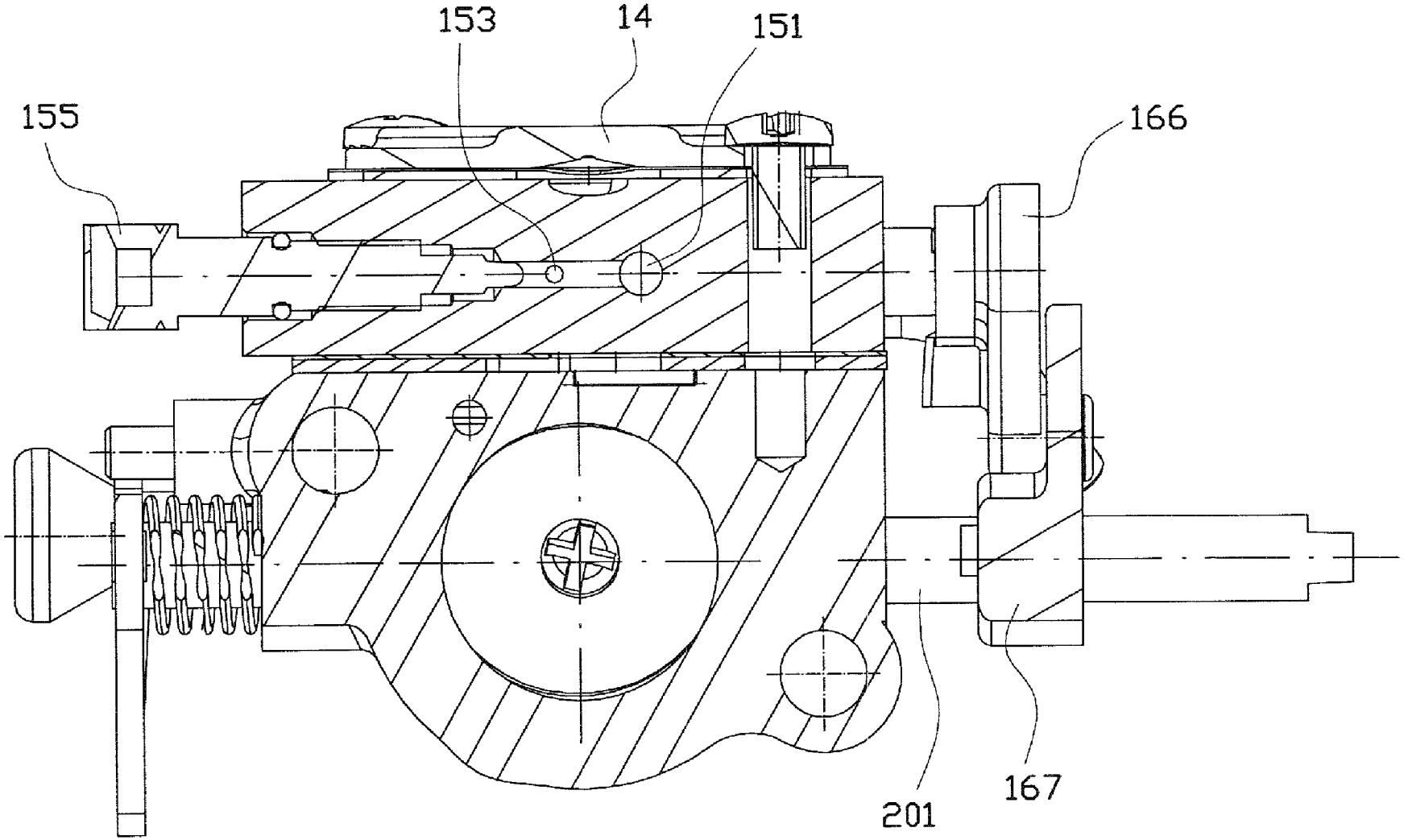
FIG. 14 shows a sectional view taken along the lines XIV-XIV shown in FIG. 12.
Figure 15:
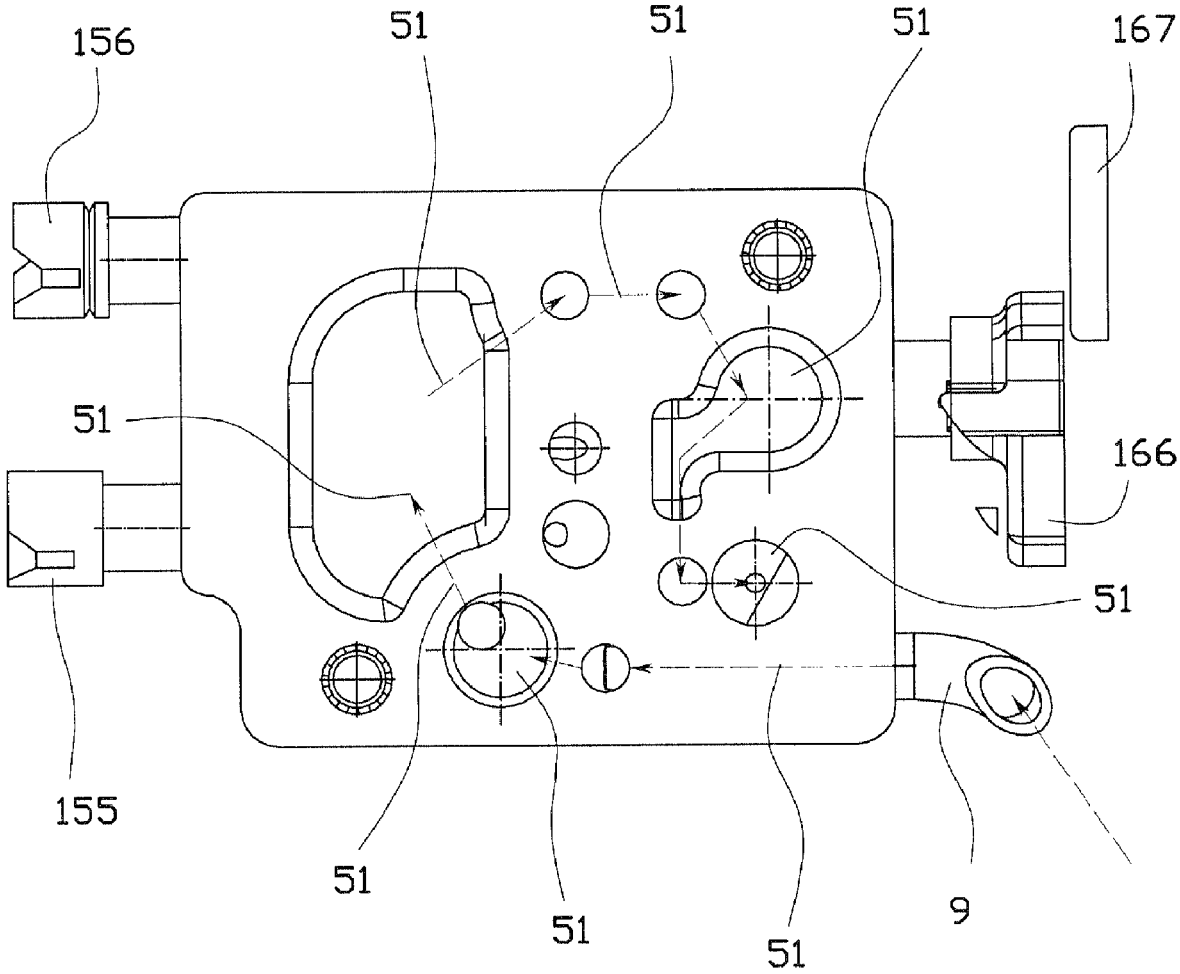
FIG. 15 shows a sectional view taken along the lines XV-XV shown in FIG. 4.
Figure 16:
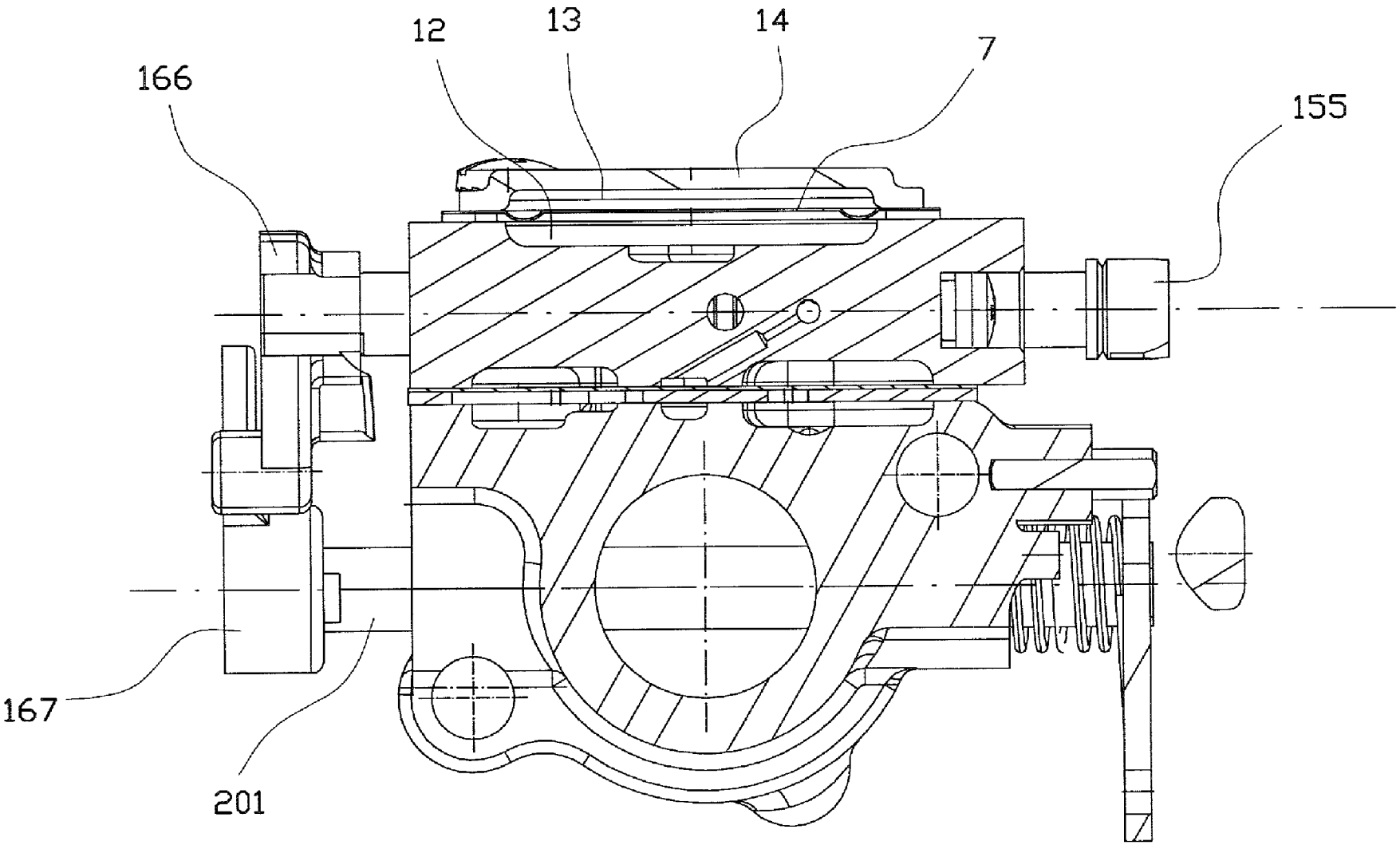
FIG. 16 shows a sectional view taken along the lines XVI-XVI shown in FIG. 10.

The diaphragm pump 6 defines two chambers which are separate from each other, a pulse chamber 11 and a fuel chamber 10, respectively (FIG. 5).

The pulse chamber 11 is placed in communication with a pulse intake duct 8 communicating with the engine crankcase so to be reached by the pressure pulses generated by the movement of the piston in the engine during its functioning.

The fuel chamber 10 is in communication with the fuel tank, the latter not illustrated, from which fuel is drawn through a fuel intake 9.

In particular, the access to the fuel chamber 10 is intercepted by an inlet valve, and the outlet of the same chamber 10 is intercepted by an outlet valve, for example valves of reed type, not visible in the figures.

The pulses coming from the engine make the diaphragm pump 6 oscillate. Such oscillations permit the delivery of the fuel from the fuel chamber 10 towards the fuel supply duct 51, entirely made in the block 5, and the contextual drawing of new fuel through the fuel intake 9. The fuel supply duct 51 is partially visible in FIG. 11 and FIG. 15.

The fuel is delivered from the diaphragm pump 6 to the metering chamber 12.

In particular, the fuel supply duct 51 is intercepted by a needle valve 120 controlled by the metering diaphragm 7, against a spring 121, as known in the art of the field and therefore not described in detail, nor illustrated here.

Figure 4:
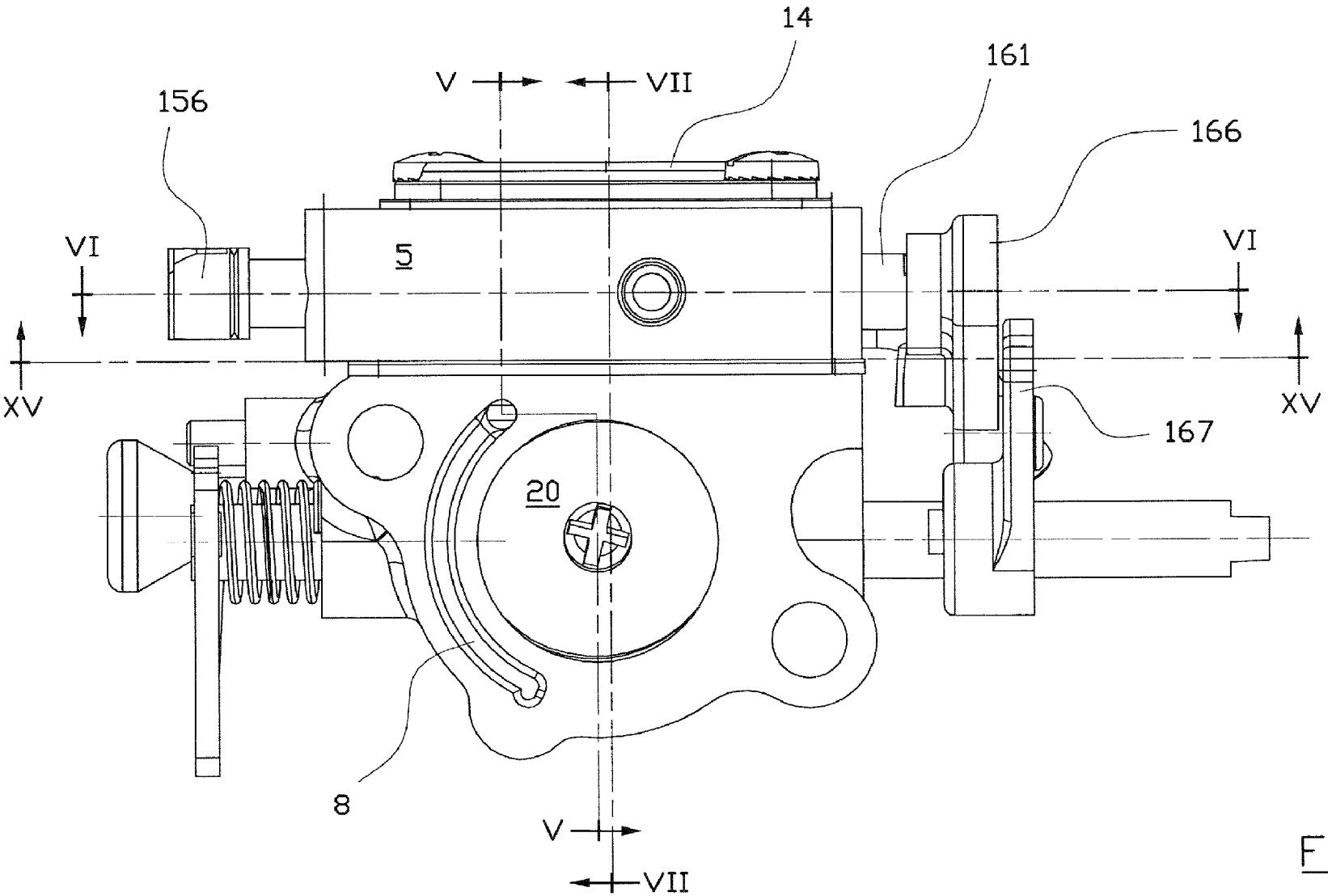
FIG. 4 shows a side view of the carburettor of FIG. 1.

The diaphragm meter 7 defines two chambers separate from each other, the metering chamber 12 and a chamber 13, respectively, the latter held at a relatively constant pressure (FIGS. 4, 5).

In the example, the chamber 13 is held at atmospheric pressure and is isolated through a cover 14 screwed on the top of the block 5, and comprising the hole 141.

The metering chamber 12 is placed in communication with the venturi duct 3 through two insertion openings 15 and 150 (FIG. 3 and FIG. 4).

In the CWI systems the metering chamber is also selectively in communication with the accumulation conduit **162'*n* of the system (FIG. 3**A)

Operatively, the reduced pressure created in the venturi duct 3, crossed by air, sucks from the metering chamber 12, through the insertion openings 15 or 150, the fuel necessary to form the correct air/fuel mixture to be fed to the engine.

The fuel drawing places the metering chamber 12 in reduced pressure, which causes the deformation of the diaphragm 7 which thus opens the needle valve 120, permitting fuel, delivered by the diaphragm pump 6, to once again reach the metering chamber 12 and therefore be inserted in the venturi duct 3.

More in detail the first insertion opening 15 is intended to feed the fuel in normal operating mode of the engine, and the second insertion opening 150 is intended to feed the fuel in idle operating mode of the engine. When the second butterfly valve 200 is closed, the choke (starter) operating mode of the engine occurs.

The first opening 15 communicates, through a first duct 151, with a distributor device 160 in which a cylindrical valve member 161 is placed. The opening 150 communicates with the distributor device 160 through a second duct 152.

The distributor device 160 is placed in the block 5.

Both the first and the second ducts 151 and 152 are in communication, through air ducts 153 and 154, with the air filter, and respectively comprise registration screws 155 and 156 downstream of the air ducts.

The distributor device 160 communicates through the duct 162 with the venturi duct 3.

In the configuration of FIG. 3 the distributor device 160 allows only the fuel of the duct 152 to be fed to the venturi duct 3, through the holes 163 and 164 of the cylindrical valve member 161.

In the configuration in which the cylindrical valve member 161 is rotated of 90°, only the fuel of the duct 151 is allowed to reach the venturi duct 3.

The amount of fuel fed to the venturi tube in the idle mode or in normal mode is registered by the screws 156 and 155.

Figure 1:
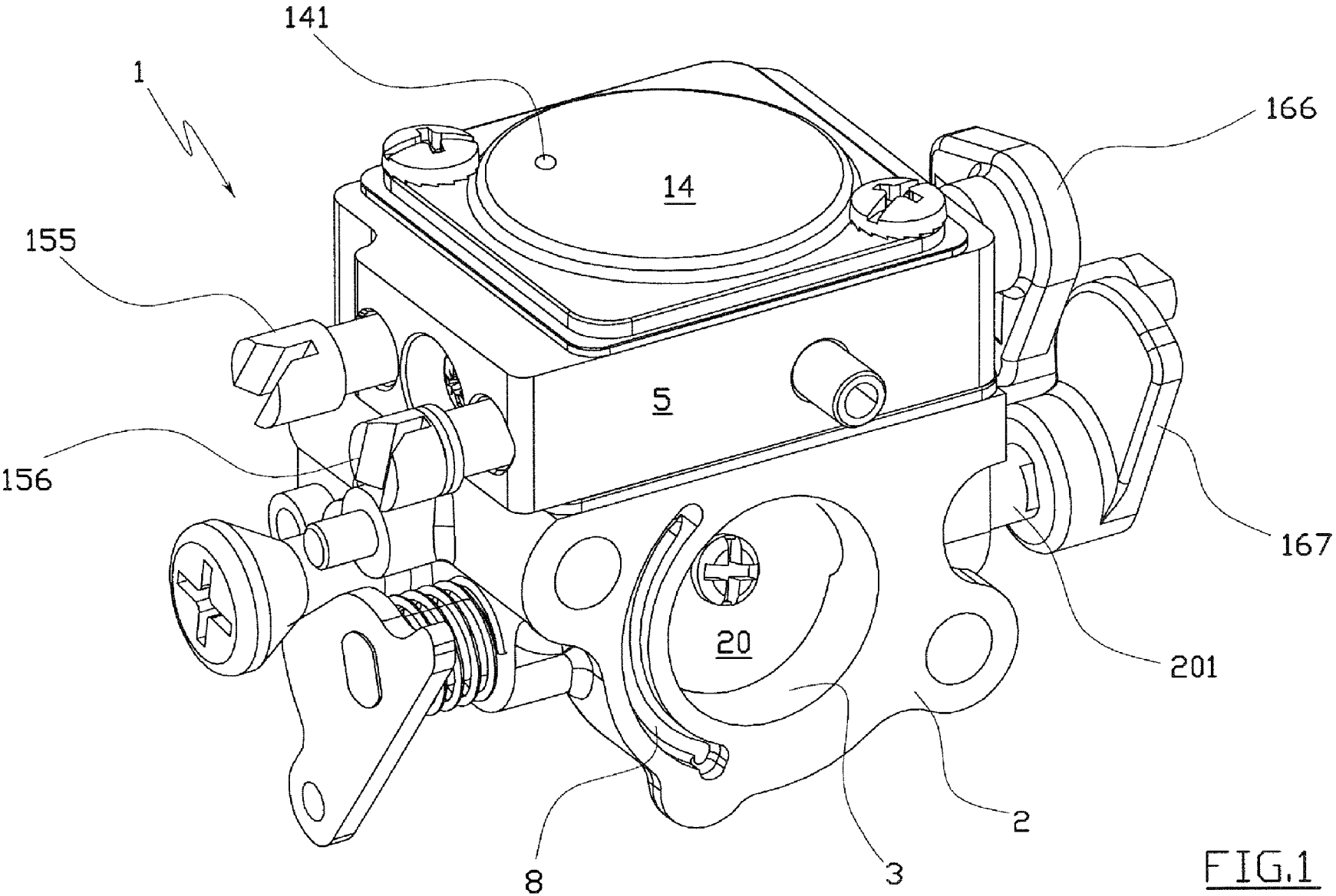
FIG. 1 shows a perspective view of a diaphragm carburettor with single pump and meter block, in accordance with the present invention.
Figure 2:
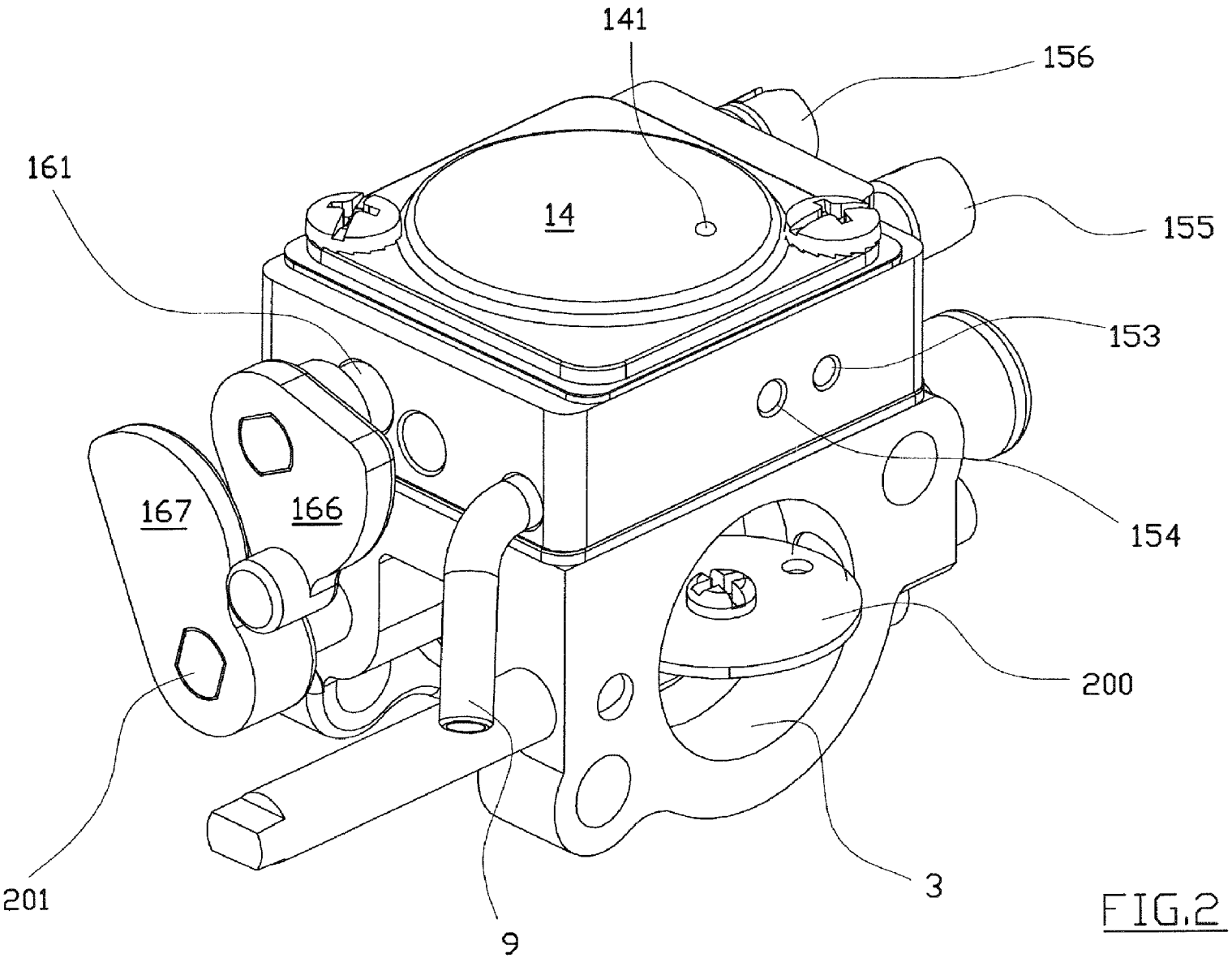
FIG. 2 shows another perspective view of the carburettor.

The cylindrical valve member 161 is commanded to rotate by the same means commanding the butterfly valve 20, namely by a cam 167 keyed on the axis 20' of the butterfly valve and moving the follower of a lever 166 keyed on the valve member 161 (FIG. 2).

In accordance with the present invention, the fuel chamber 10 and the metering chamber 12 are made on two opposite faces of the block 5 at respective impressions.

In particular, a housing 11 is made on the carburettor body 2 at the positioning of the impression of the block 5, corresponding with the fuel chamber 10.

Said housing 11 is in communication with the engine crankcase through the pulse intake duct 8 and carries out the function of pulse chamber 11.

In substance, the pump with diaphragm 6 is interposed between the block 5 and the carburettor body 2 respectively at the fuel chamber 10, made in the block 5, and the pulse chamber 11, is made on the carburettor body 2.

In the example, the block 5 is made of aluminum by pressure die-casting.

In accordance with a second embodiment of the present invention, the carburettor body 2 according to the first embodiment can be substituted with a carburettor body 2' having in addition to the venturi duct 3, a further duct 3' intercepted by a butterfly valve (not illustrated) adapted to insert additional air to the engine.

The block 5 remains that described above, permitting in such a manner the easy passage from the carburettor body 2 to the carburettor body 2' and vice-versa.

Moreover, due to the availability of all the adjustment systems on a single block, it is possible to have the timed management of the double butterfly by simply connecting the two rotation shafts of the two butterfly valves with two side cams. This permits having the rotation axes of the butterfly valves perpendicular to the axis of the two ducts, allowing easier adjustment. The prior art, on the other hand, employs valves having rotation shaft axes arranged slanting, due to problems of size.

As may be appreciated from that described above, the diaphragm carburettor according to the present invention permits satisfying the needs and overcoming the drawbacks mentioned in the introductive part of the present description with reference to the prior art.

In fact, the carburettor according to the present invention comprises a single block, in which both the pump and the meter are incorporated, which allows passing from the standard feed technology, with only one venturi, to the stratified charge feed technology, and vice-versa, by simply substituting the carburettor body, while it leaves the single block entirely unchanged, which is easily fixed to the new carburettor.

Moreover, said carburettor with single block allows reducing the overall size without compromising the ease of use, making the adjustment screws easily accessible, which are all situated on the single block. Not to be overlooked is the possibility of having a stratified charge carburettor with an extremely simplified timed management of the double butterfly.

Of course, a man skilled in the art, in order to satisfy specific and contingent needs, can make numerous modifications and variants to the diaphragm carburettor as described above, all moreover contained in the protective scope of the invention as defined by the following claims.

The invention claimed is:

1. Diaphragm carburetor (1) for internal combustion engines, comprising:

a carburetor body (2,2') provided with a feed duct (3) of an air/fuel mixture to the engine, said duct (3) being intercepted by at least one butterfly valve (20);

pumping means comprising a diaphragm pump (6) communicating on one side with the crankcase of the motor and on the other side with a fuel tank, said diaphragm pump (6) being driven by the pulses coming from the motor;

metering means comprising a diaphragm meter (7) adapted to keep a first chamber (13) and a second chamber (12) separate, with said diaphragm meter (7) interposed, said first chamber (13) being at environment pressure, and said second chamber (12) communicating both with said diaphragm pump (6), on the side which communicates with the tank, through a line intercepted by a valve controlled by the diaphragm meter (7) itself, and said feed duct (3) of the mixture, characterized in that said pumping means and said metering means are integrally made on a single block (5) fixed directly on one side of the carburetor body (2).

2. Carburetor (1) according to claim 1, wherein said block (5) has a first impression (10) and a second impression (12) made on two opposite faces on which said diaphragm pump (6) and said diaphragm meter (7) are respectively fixed, said first impression (10) and said second impression (12) respectively defining a fuel chamber and a metering chamber, the latter coinciding with said second impression (12).

3. Carburetor (1) according to claim 2, wherein said carburetor body (2) is provided with a housing (11), having the function of pulse chamber, made at said first impression (10) and placed in communication with the engine crankshaft through a pulse intake duct, said diaphragm pump (6) being interposed between said housing (11) and said first impression (10).

4. Carburetor (1) according to claim 2, wherein a cover (14) is fixed on said block (5) at said second impression (12), the internal side of said cover (14) forming said first chamber (13) with said diaphragm meter (7).

5. Carburetor (1) according to claim 2, wherein said block (5) is crossed by a distributor device (160) located between said first impression (10) and said second impression (12), through which the metering chamber(12) is in communication with the venturi tube.

6. Carburetor according to claim 5 wherein said distributor device comprises a cylindrical valve member (161) which selectively puts into communication two insertion openings (15, 150) of the metering chamber with the venturi tube (3) and the accumulation conduit (162') of a CWI system.

7. Carburetor according to claim 6 wherein each insertion opening (15, 150) communicates with the distributor device through first (151) and second (152) ducts, both the first and the second ducts (151, 152) being in communication, through air ducts (153, 154), with the air filter, and respectively comprise registration screws (155, 156) downstream of the air ducts.

8. Carburetor according to claim 6 wherein the cylindrical valve member (161) is commanded to rotate by the same means commanding the butterfly valve (20), comprising a cam (167) keyed on the axis (20') of the butterfly valve and moving the follower of a lever (166) keyed on the valve member (161).

9. Carburetor (1) according to claim 1, wherein said block (5) is provided with air intakes (17).

10. Carburetor (1) according to claim 1, wherein said block (5) is made of aluminum by pressure die-casting.

11. Carburetor (1) according to claim 1, wherein said carburetor body (2') is further provided with an air intake duct (3') intercepted by a butterfly valve.

* * * * *